US009649572B2

(12) United States Patent
Strand

(10) Patent No.: US 9,649,572 B2
(45) Date of Patent: May 16, 2017

(54) POSITIONING MECHANISM FOR CONSTRUCTION TOY

(71) Applicant: LaVonne Strand, Folcroft, PA (US)

(72) Inventor: LaVonne Strand, Folcroft, PA (US)

(73) Assignee: K'NEX Limited Partnership Group, Hatfield, PA (US)

( * ) Notice: Subject to any disclaimer, the term of this patent is extended or adjusted under 35 U.S.C. 154(b) by 0 days.

(21) Appl. No.: 14/090,613

(22) Filed: Nov. 26, 2013

(65) Prior Publication Data

US 2015/0147934 A1 May 28, 2015

(51) Int. Cl.

| | |
|---|---|
| ***A63H 33/08*** | (2006.01) |
| ***A63H 33/10*** | (2006.01) |
| ***A63H 33/04*** | (2006.01) |
| ***A63H 33/06*** | (2006.01) |

(52) U.S. Cl.

CPC ..... *A63H 33/101* (2013.01); *A63H 33/042* (2013.01); *A63H 33/062* (2013.01)

(58) Field of Classification Search

CPC ..... A63H 33/08
USPC ..... 446/126
See application file for complete search history.

(56) References Cited

U.S. PATENT DOCUMENTS

| | | | | |
|---|---|---|---|---|
| 2,683,329 | A | 7/1954 | Kobler | |
| 5,259,803 | A | 11/1993 | Lyman | |
| 5,350,331 | A * | 9/1994 | Glickman | 446/126 |
| 5,542,871 | A | 8/1996 | Gabriel | |
| 5,785,572 | A | 7/1998 | Levy et al. | |
| 5,897,417 | A * | 4/1999 | Grey | 446/125 |
| 5,913,706 | A * | 6/1999 | Glickman et al. | |
| 6,068,533 | A * | 5/2000 | Glickman et al. | 446/111 |
| 6,089,941 | A * | 7/2000 | Glickman et al. | 446/111 |
| 6,286,649 | B1 * | 9/2001 | Gleim | 192/46 |
| 6,398,612 | B2 * | 6/2002 | Gudger | 446/125 |

(Continued)

FOREIGN PATENT DOCUMENTS

| | | |
|---|---|---|
| CN | 1025289 C | 7/1994 |
| CN | 2283508 Y | 6/1998 |

(Continued)

*Primary Examiner* — Aarti B Berdichevsky
*Assistant Examiner* — Dolores Collins
(74) *Attorney, Agent, or Firm* — St. Onge Steward Johnston & Reens, LLC

(57) ABSTRACT

A positioning mechanism for use in conjunction with rod and connector construction toy sets, such as K'NEX, to enable incrementally adjustable positioning of rods relative to associated connectors. The new mechanism includes first and second positioning members. The first, positioning member is, mounted on a rod for angular movement and includes a cylindrical outer surface with multiple detent notches. The second positioning member has a convergent pair of resilient fingers engaged with a spaced pair of the detent notches to releasably retain the first positioning member in any incrementally adjusted position. The second positioning member includes mounting studs engageable with laterally spaced connectors of an assembly, and a separate locating element engageable with at least one of the connectors to fix the second positioning member against rotation. The first and second positioning members are easily incorporated into otherwise standard rod and connector structures to achieve the desired incremental adjustability.

11 Claims, 7 Drawing Sheets

(56) References Cited

U.S. PATENT DOCUMENTS

| | | | | |
|---|---|---|---|---|
| 6,581,931 | B1 * | 6/2003 | Doepner et al. | 273/118 A |
| 6,620,022 | B1 * | 9/2003 | Smith et al. | 446/454 |
| 7,044,825 | B2 * | 5/2006 | Glickman et al. | 446/121 |
| 7,588,476 | B2 * | 9/2009 | Hammond | 446/104 |
| 7,666,054 | B2 * | 2/2010 | Glickman et al. | 446/124 |
| 2012/0034839 | A1 * | 2/2012 | Murphy | 446/124 |

FOREIGN PATENT DOCUMENTS

| | | | |
|---|---|---|---|
| EP | 0490033 | A1 | 6/1992 |
| KR | 20060117657 | A | 11/2006 |
| WO | 9009825 | A1 | 9/1990 |

* cited by examiner

POSITIONING MECHANISM FOR CONSTRUCTION TOY

FIELD OF THE INVENTION

The present invention relates to construction toys, and more particularly to rod and connector type construction toys such as those marketed under the registered trademark "K'NEX". A fundamental part of the K'NEX construction toy system is the provision of a rod and connector arrangement in which rods may be joined with connectors by a lateral snap-in action by which the components are held in a substantially rigid relation. The K'NEX construction toy system is also designed and constructed to enable interfacing with bricks, such that complicated hybrid structures of bricks, rods and connectors may be assembled. The present invention relates to certain improvements in the K'NEX construction toy system which facilitate the assembly of elements in a manner to accommodate the adjustable positioning thereof.

BACKGROUND OF THE INVENTION

A typical K'NEX construction toy set is furnished with multiple rods of various lengths, based upon a specific system of graduated lengths as described in, for example, the Glickman U.S. Pat. No. 5,350,331, the content of which is incorporated herein by reference. The typical set also includes a variety of generally flat connectors, each provided with a hub and one or a plurality of up to eight rod-receiving sockets disposed at regular angular intervals of 45°. Some connectors are arranged to be joined together at right angles to provide multiple rod-receiving sockets extending in two planes. Because of the basic structure of the connectors, rods joined therewith are for the most part rigidly mounted with respect to other rods. In some cases, the hub of the connector may be supported by a rod for rotational movement, but in such cases the connector may rotate freely about the axis of the rod. While the rotational connector may be fixed in one or more angular orientations in a finished structure, it is not incrementally adjustable. There remains a need for a simple, effective, easily constructed mechanism to enable incremental rotational positioning of assembled rigid components in a K'NEX rod and connector construction set, especially for poseable action figures and the like.

SUMMARY OF THE INVENTION

The invention relates to a novel form of positioning mechanism for a rod and connector construction toy set, enabling a rod, joined with a connector, to be incrementally angularly positioned in relation to adjacent rod and connector elements. The mechanism is particularly advantageously suited for, but in no way limited to, the construction of poseable action figures utilizing in some significant part rod and connector structural elements as provided, for example, in a K'NEX construction toy set. The mechanism of the invention comprises a first positioning member which is laterally confined between two standard connectors and rotatably supported upon a rod engaged by and extending transversely between the two standard connectors. The first positioning member includes a rod-gripping socket whereby a rod, engaged in said socket, can be rotationally positioned relative to the two standard connectors. A cylindrical outer surface portion of the first positioning member, coaxial with the transversely disposed rod on which it is mounted, is provided with a series of angularly closely spaced positioning teeth. A second positioning member has coaxial projections from opposite sides thereof which are received in opposed hub openings of the standard connectors. The main body of the second positioning member is closely confined between the standard connectors, and a third projection, extending from one side of the second positioning member, engages an opening in one of the standard connectors, radially spaced from the hub opening, such that the second positioning member is non-rotationally secured relative to that connector. A spaced apart pair of resilient positioning fingers (sometimes referred to herein as detent fingers) extend from the body of the second positioning member and engage the positioning teeth of the first positioning member. The first and second positioning members form a unique assembly with the standard connectors and enable incremental angular positioning of the first positioning member relative to the assembly as a whole. The mechanism is ideally suited for knee or elbow joints, for example, of mechanical action figures constructed at least in part of rod and connector components. It will be understood, in this respect, that reference herein to structures constructed of rod and connector components will also embrace such structures when constructed in hybrid form, using rods, connectors and bricks, as well as other components.

Pursuant to the invention, the unique design and configuration of the first and second positioning members enables them to be incorporated in a variety of ways within an assembly of rod and connector components to accommodate incremental positional adjustment of certain of the components relative to the structure as a whole.

For a more complete understanding of the above and other features and advantages of the invention, reference should be made to the following detailed description of a preferred embodiment thereof and to the accompanying drawings.

DETAILED DESCRIPTION OF THE INVENTION

Figure 2:
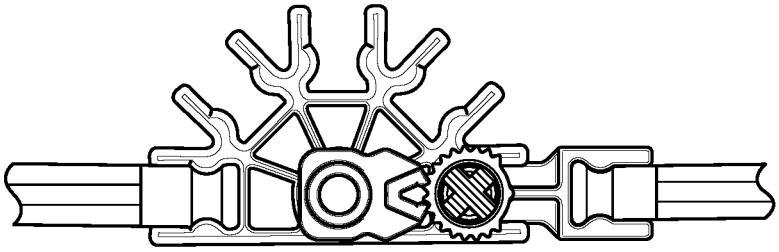
FIG. 2 is a cross sectional view as taken generally on line 2-2 of FIG. 3
Figure 1:
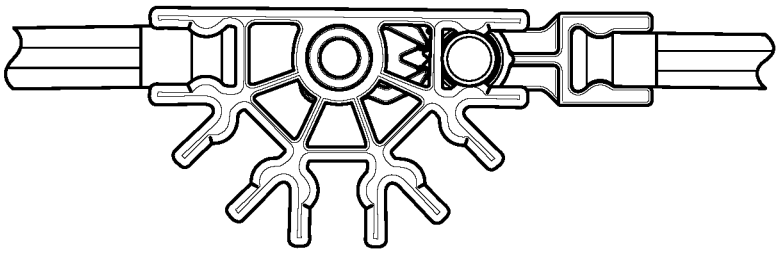
FIG. 1 is a side elevational view of a simple joint assembly constructed with rod and connector components in accordance with principles of the invention.

Referring to the drawing, the reference numerals 20, 21 designate connector elements of a type typically utilized in K'NEX construction toy sets. The illustrated connectors are 180° connectors, which are provided with five rod-engaging sockets 22 of generally U-shaped configuration adapted, in a manner known with K'NEX construction toy sets, to accommodate lateral snap-in assembly of rods 23-25 to form a relatively rigid assembly, in which the rods are disposed in fixed relation to the connectors, along axes defined by the sockets 22. It will be understood that the use of 180° connectors 20, 21 is illustrative only, as connectors may be utilized with a greater or lesser number of rod sockets.

Each of the connectors has a cylindrical hub 26 forming a cylindrical opening 26*a* aligned along a hub axis. The axes of the several rod-gripping sockets 22 of a connector lie in a common plane and each intersects the hub axis of that connector at right angles thereto. In a standard K'NEX construction toy set, as described in U.S. Pat. No. 5,350,331, the rod-engaging sockets are disposed with their respective socket axes spaced at 45° such that, in assembly of rods and connectors, the rods can be disposed at angles of 45° or multiples of 45°. Each rod socket 22 is comprised of an end wall 22*a*, disposed at right angles to the socket axis and arranged to support the end of a rod held in the socket, and spaced apart side walls 22*b*, 22*c* extending outward from the end wall 22*a* and disposed parallel to and equidistant from the socket axis. The side walls 22*b*, 22*c* are arranged to resiliently grip side wall portions of a rod (see FIG. 2) and are formed with longitudinal grooves 22*d* which serve to hold a gripped rod firmly in alignment with the socket axis. Pursuant to teachings of the above mentioned '331 patent, the bottom wall 22*a* of each rod socket 22 in each connector is located a fixed radial distance from the hub axis. This is true for all connectors regardless of the number of rod sockets provided in the connector.

Each socket is adapted, in a manner known with K'NEX construction toy sets, to accommodate snap together assembly of rods and connectors to form a relatively rigid assembly. Preferably, each socket is adapted for lateral snap-in assembly of a rod into the socket by aligning a longitudinal axis of a rod parallel to the socket axis of a socket and urging the end of the rod into the socket in a direction perpendicular to the socket axis. The arrangement is such that when assembled the socket axis and the longitudinal axis of the rod are coaxial. Alternatively, transverse snap-in assembly of a rod into a socket can be accomplished by aligning the longitudinal axis of the rod perpendicular to the socket axis and urging an intermediate portion of the rod into the socket in a direction parallel to the socket axis. When the rod and socket are thus assembled, the longitudinal axis of the rod intersects with and is perpendicular to the socket axis, and the rod is non-rotationally gripped by the socket.

Also as described in U.S. Pat. No. 5,350,331, rods of the construction toy set are provided in graduated lengths according to a predetermined progression of lengths, such that when rods and connectors are assembled in the form of a right isosceles triangle, rods of one size in the progression can form the two sides of the triangle while a rod of the next larger size in the progression forms the hypotenuse. The rods are provided with annular grooves 27 (FIG. 2) adjacent to their opposite ends which, during lateral snap-in connection of the rod, interlock with transverse ribs 28 in the socket side walls 22*b*, 22*c* to restrain the rods against axial movement out of the sockets in which they are engaged.

Figure 4:
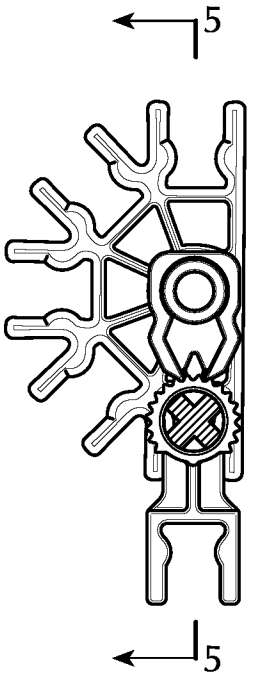
FIG. 4 is a cross-sectional view as taken generally on line 4-4 of FIG. 3 but omitting a showing of the rods.
Figure 3:
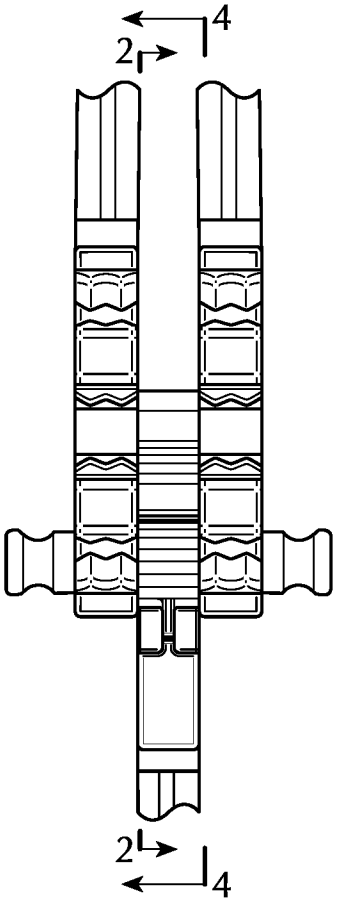
FIG. 3 is a front elevational view of the joint assembly of FIG. 1.
Figure 5:
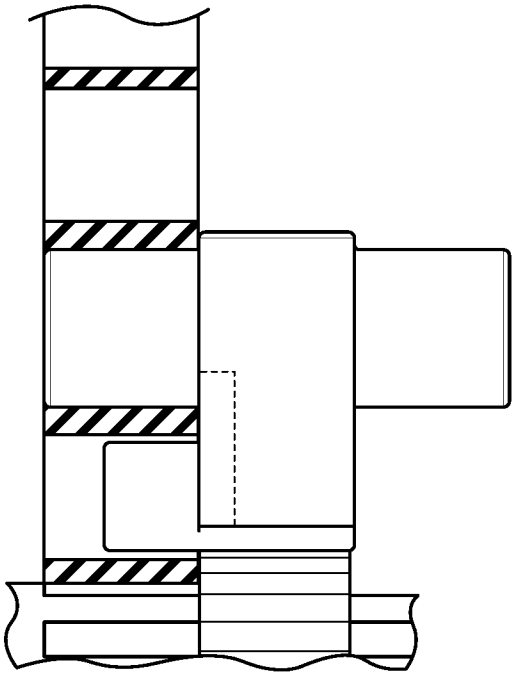
FIG. 5 is an enlarged, fragmentary cross-sectional view as taken generally on line 5-5 of FIG. 4.

In the mechanism of the invention, the illustrated pair of connectors 20, 21 are joined together in closely spaced apart relation, with the hub axes thereof coaxially aligned, primarily by means of a short rod 29 which is gripped in transversely disposed relation in sockets 22 of each of the connectors 20, 21. As indicated in FIGS. 2, 4 and 5, the rod 29, which can be a standard K'NEX rod, has an X-shaped cross section over most of its length between cylindrical collar portions 30, 31 at its opposite ends. This cross sectional shape forms two pairs of opposed V-shaped grooves 32, 33. One of the pairs of opposed V-shaped grooves of the transverse rod 29 is engaged by opposing transverse ribs 28 in the rod sockets 22 of the connectors 20, 21, such that the rod 29 is tightly gripped by, and non-rotatable relative to, the spaced apart connectors 20, 21 and such that a longitudinal axis of the rod 29 is parallel to the hub axis of each connector 20, 21.

Pursuant to the invention, a first positioning member 34 (see FIGS. 7 and 8) is supported on an intermediate portion 35 of the rod 29 extending between the two connectors 20, 21. The first positioning member has a cylindrically tubular end portion 36, which is closely received on the intermediate rod portion 35 such that the first positioning member is rotatable relative to the rod 29 and connectors 20, 21 while being closely confined laterally between the two connectors. The first positioning member has a neck portion 37 extending radially from the tubular end portion 36, and a rod gripping portion 38 is joined with the neck portion 37 in radially spaced relation to the end portion 36. The rod gripping portion 38 includes a socket 39 of a generally U-shaped configuration corresponding in all relevant respects to the rod gripping sockets 22 of the standard connectors 20, 21. In the illustrated form of the invention, the opposed side walls 40, 41 of the rod socket 39 are disposed in planes parallel to the central axis of the tubular end portion 36, and the length of the neck portion 37 is such that the end wall 42 of the socket 39 is spaced the same radial distance from the axis 43 of the tubular end portion 36 as the end walls 22*a* of the standard connectors are spaced from the hub axis of the connector.

Figure 8:
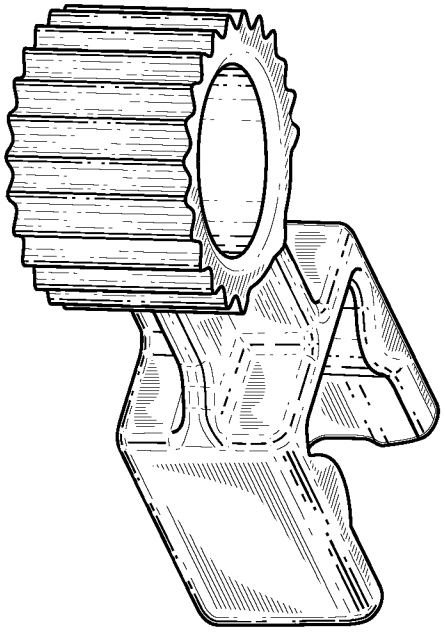
FIGS. 7 and 8 are a side elevation and orthographic views, respectively, of a first positioning element forming part of the joint assembly of the invention.
Figure 7:
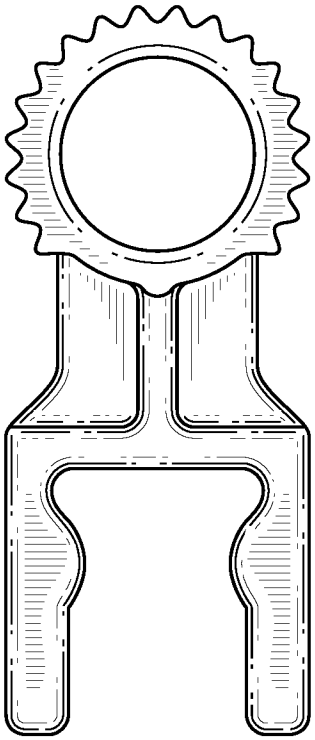
Figure 9:
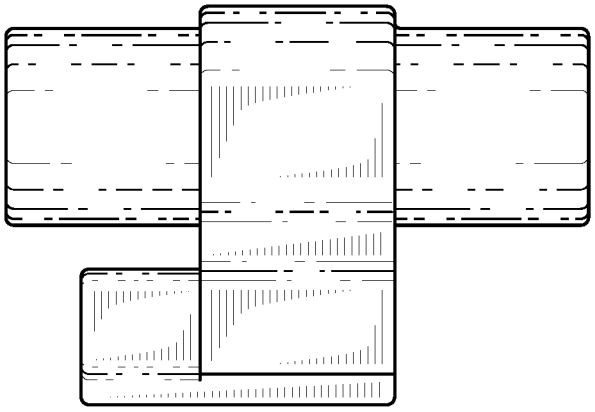
FIG. 9 is a side elevational view of a second positioning element forming part of the joint assembly of the invention.
Figure 10:
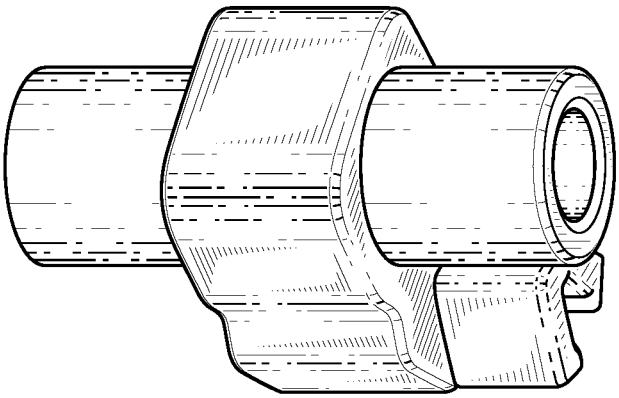
FIGS. 10 and 11 are orthographic views, from opposite ends, of the second positioning element of FIG. 9
Figure 11:
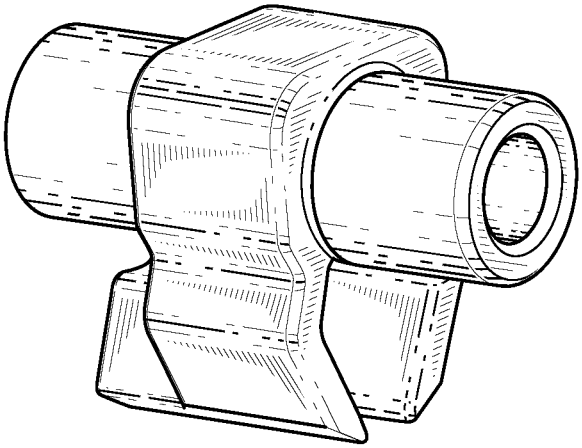
Figure 12:
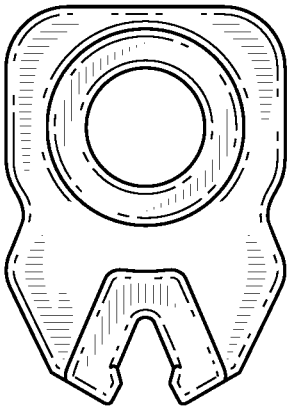
FIGS. 12 and 13 are opposite and elevational views of the second positioning element of FIG. 9.
Figure 13:
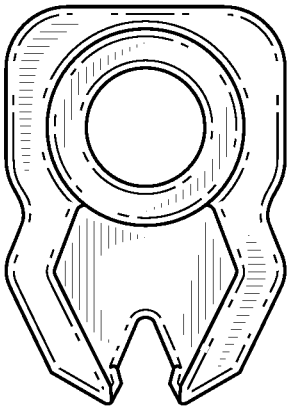
Figure 14:
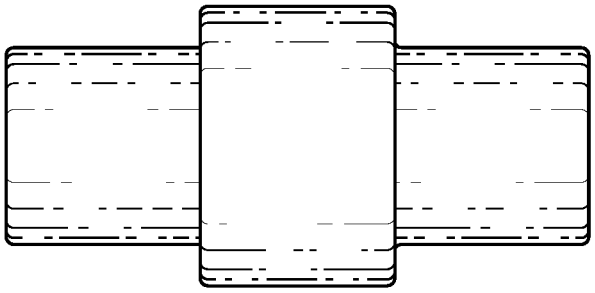
FIGS. 14 and 15 are top and bottom plan views, respectively, of the second positioning element of FIG. 9.
Figure 15:
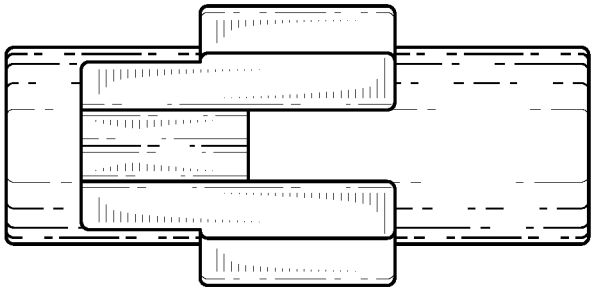

As shown particularly in FIGS. 7 and 8, the tubular end portion 36 of the first positioning member is cylindrically contoured over most of its external surface (e.g., over an arc of about 260° in the illustrated example), from one side of the neck portion 37 to the other. This external surface is provided with a plurality of teeth formed by angularly closely spaced generally V-shaped notches 44, which are disposed in parallel relation to the axis of the tubular end portion 36 and preferably extend over the full width of the end portion. By way of example and not of limitation, in a first positioning member having a tubular end portion 36 with a 0.25 inch internal diameter and an approximate outside diameter of about 0.288 inch, a series of about 18 V-shaped notches 44 are provided. In the example part, the notches are about 0.028 inch deep and have an included angle of about 86°.

Pursuant to the invention, the first positioning member 34 cooperates with a second positioning member 45, which is engaged with the connectors 20, 21, in fixed relation thereto, in such manner that the first positioning member may be rotationally adjusted about the rod 29 to any of a variety of rotational positions, within the physical limits provided for, and releasably retained in such rotationally adjusted position until intentionally moved therefrom. The second positioning member 45, details of which are illustrated in FIGS. 9-15, comprises a main body portion 46 having spaced apart side walls 47, 48, a top wall 49 and front and back walls 50, 51. It will be understood, of course, that terms such as front, back, side, top, bottom, up, down, etc., as used herein, are used only in an illustrative and non-limiting sense, with reference to the various parts and assemblies in their illustrated orientations. In actual practice the parts and assemblies may be used in a variety of directional orientations.

Figure 6:
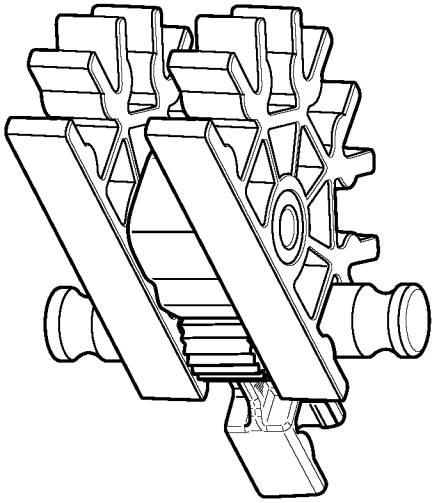
FIG. 6 is an orthographic view of the joint assembly of the FIGS. 1-3, with the rods omitted from the assembly.

The illustrated second positioning member 45 of FIGS. 9-15 advantageously is formed by injection molding of an engineering plastic material such as "Celcon" brand acetyl polymer manufactured by Celanese Corporation. In the illustrated and preferred form of the invention, the second positioning member 45 includes a pair of mounting studs 52, 53 which extend from opposite sides of the body portion 46. The mounting studs preferably are of cylindrically tubular form and are aligned on a common axis. The mounting studs are of a diameter (e.g., 0.25 inch) to be closely received within the hubs 26 of the connectors 20, 21 as shown for example in FIGS. 5 and 6 of the drawings. The sidewalls 47, 48 of the body portion partially surround and extend outward from the mounting studs 52, 53 to form abutment surfaces against which a pair of spaced apart connectors 20, 21 can be seated and supported in the desired spaced relation.

A panel 54 extends downward at one side of the body portion 46 and an outer surface 55 thereof forms part of the body side wall 48. The panel 54 advantageously is formed with a recess 56 at a lower edge thereof which is of inverted V-shape. Extending laterally outward from the outer panel surface 55 is an anti-rotation locating element 57 which is of an inverted V-shaped cross section, as shown particularly in FIG. 12. The locating element 57 extends parallel to and in spaced relation from the mounting stud 53. The shape and positioning of the locating element 57 is such that, when the mounting stud 53 is engaged in the hub 26 of a connector (see FIG. 5), the locating element 57 can be received in any one of the keystone-shaped openings 58 or trapezoidal openings 59 of the connectors 20, 21. When so received, the locating element 57 locks the second positioning member 45 against any rotation relative to the connector 20 (and since the connector 20 is secured in fixed relation to the connector 21, the positioning member 45 is also secured against rotation with respect to the connector 21).

Pursuant to an aspect of the invention, the second positioning member 45 is provided at the front and back of the body portion 46 with spaced apart and downwardly extending detent or positioning fingers 60, 61. The detent fingers preferably are of a width equal to the width of the body portion 46 and are thus closely confined between the two connectors 20, 21 in the illustrated assembly. The positioning fingers 60, 61 are symmetrically arranged with respect to a vertical plane 62 bisecting the second positioning member 45, as shown in, for example, FIGS. 12 and 13. Lower portions of the positioning fingers 60, 61 advantageously are convergently disposed at an angle to each other of about 53°. At one side edge thereof, the detent fingers are integrally joined with the sides of the downwardly extending panel 54. In the specifically illustrated form of the invention, the lower extremities 63, 64 of the positioning fingers 60, 61 are of a somewhat pointed, V-shaped configuration. As seen best in FIG. 13, the lowermost surfaces of the extremities 63, 64 are disposed at an angle of approximately 60° to the vertical plane 62, and the pointed lower ends may have an included angle of slightly less than 90°.

As is evident particularly in FIGS. 2 and 4, the length of the positioning fingers 60, 61 is such that, when the second positioning member 45 is positioned with its mounting studs 52, 53 received in the connector hubs 26, and the first positioning member 34 is supported by the transverse rod 29 secured in a pair of opposed rod sockets 22 of the connectors 20, 21, the pointed lower ends 63, 64 of the positioning fingers are engaged with a spaced pair of the V-shaped detent notches 44 in the outer surface of the first positioning member 34. In the illustrated arrangement, the notches 44 engaged by the finger ends 63, 64 are spaced apart by one intervening notch. In this configuration, the common axis of the mounting studs 52, 53 and the axis of the rod 29 define a plane, corresponding to the previously identified plane 62 about which the positioning fingers 60, 61 are symmetrically arranged.

When the positioning fingers 60, 61 are engaged with a pair of detent notches 44 on the first positioning element 34, the first positioning element is firmly held in a fixed rotational orientation with respect to the other assembled components. However, the first positioning element may be forcibly repositioned by gripping either the rod gripping portion 39, or a rod engaged therein and applying a sufficient rotating force thereto. The elements of the first and second positioning elements 34, 45 have sufficient resilience and elasticity to enable the positioning fingers to be momentarily displaced sufficiently to bring adjacent sets of detent notches 44 into alignment therewith. As soon as the rotating force is released, the first positioning element 34 will be held firmly in the newly adjusted position until the next occasion when intentional repositioning rotational forces are applied. In the illustrated and preferred form of the invention, the tubular end portion 36 of the first positioning member is formed with detent notches over a sufficient angular portion of its surface to accommodate positional adjustment of the first positioning member 34 relative to the second positioning member 45 of at least about 180°. The arrangement enables the first positioning member 45 to be adjusted to and retained in a plurality of incrementally discrete angular orientations relative to the first positioning element 34.

It will be readily appreciated that the configured arrangement of FIGS. 2 and 4, for example, can be rearranged by positioning the rod 29 in any of the available rod sockets 22 of the connectors 20, 21, since the rod 29 will, in any of the rod sockets of a connector, be positioned a predetermined distance from the hub axis of the connector such that the functional relationship of the first and second positioning members 34, 45 will remain the same. Moreover, with certain modifications, such as by configuring the mounting studs 52, 53 with an X cross-sectional shape and modifying the shape of the locating element 57, the respective positions of the first and second positioning members 34, 45 could be made reversible, such that the first positioning member 34 could be rotatably mounted on a rod received in an opposed pair of hubs 26, while the second positioning member 45 is mounted in a pair of rod sockets.

With the mechanism of the invention, the functionality of a rod and connector type construction toy set is greatly enhanced by enabling incremental positional adjustment of the angular orientation of a rod or rods relative to other parts of the structure. This is particularly useful for, but by no means limited to, the construction of robotic figures, where the builder can conveniently incrementally reposition arm and/or leg elements of the figure, with the repositioned elements remaining fixed in their new positions for normal purposes until intentionally moved to a new positions.

It should be understood, of course, that the specific forms of the invention herein illustrated and described are intended to be representative only, as various modifications may be made therein within the clear teachings of the disclosure as a whole. Accordingly, reference should be made to the following appended claims in determining the full scope of the invention.

What is claimed is:

1. An incrementally rotationally adjustable positioning device for a rod and connector construction toy set, which comprises at least two connectors, each of a type comprising a connector body formed of plastic material and including a cylindrical hub and at least two rod-gripping sockets, said hub having a hub axis and said rod-gripping sockets each having a socket axis intersecting with said hub axis at right angles thereto, each said socket having an inner end wall, spaced a uniform distance from said hub axis, and a pair of rod-gripping arms forming with said inner end wall a rod-gripping socket of generally U-shaped configuration adapted for a lateral snap-in connection with a rod element of said construction toy set, each of said rod-gripping arms having an internal rod-engaging rib on an inside thereof extending transversely to the socket axis and spaced a predetermined distance from the inner wall of said socket, at least one of said connectors having a transverse opening therein positioned radially outward from the hub thereof, at least one rod element, formed of plastic material, having flanged ends and annular grooves adjacent said flanged ends adapted for reception of said ribs, said rod element having a generally X-shaped cross section in an intermediate region between said annular grooves defining longitudinal grooves engageable by said ribs when said rod element is transversely disposed between a pair of rod-gripping arms, a pair of said connectors being arranged in spaced parallel relation, said rod element being disposed transversely with respect to said pair of connectors and being non-rotationally engaged and gripped in said intermediate region by a rod-gripping socket of each of said connectors, a first positioning member mounted between and confined laterally by said pair of connectors, said first positioning member comprising a tubular first end portion and a second end portion defining a rod-gripping socket, corresponding to a rod-gripping socket of said connectors, spaced from and rigidly connected to said tubular first end portion, the rod-gripping socket of said first positioning member having rod-gripping arms and said rod-gripping arms having rod-engaging ribs disposed in parallel relation to an axis of said tubular first end portion, said first positioning member being rotationally joined with said connectors, for predetermined angular rotation relative thereto, by a portion of said rod element extending between said connectors and passing through said tubular first end portion, said tubular first end portion being cylindrically contoured over a substantial portion of its external surface, and said cylindrically contoured surface portion being provided with a plurality of arcuately closely spaced positioning teeth extending in an axial direction on said contoured external surface and forming a plurality of discrete and angularly closely spaced detent notches, a second positioning member, formed of plastic material, mounted between and laterally confined by said connectors, said second positioning member comprising a body portion located between said connectors and at least one mounting stud projecting from said body portion and extending into and supported by a hub of at least one of said connectors, an anti-rotation element projecting laterally from at least one side of said body portion in spaced relation to said mounting stud and received in a transverse opening in at least one of said connectors to prevent rotation of said second positioning member relative to said connectors, said second positioning member further including at least one resilient detent finger extending from said body portion and having a free end extremity shaped for reception in said plurality of detent notches and extending into engagement with said detent notches, said detent finger being resiliently displaceable to accommodate forcible incremental rotation of said first positioning member relative to said connectors and to releasably retain said first positioning member in any of a plurality of incrementally discrete predetermined angular orientations with respect to said second positioning member and said connectors.

2. The positioning device of claim 1, wherein said at least one detent finger comprises a pair of resilient detent fingers symmetrically disposed on opposite sides of a plane defined by said hub axis and a longitudinal axis of said rod element, end portions of said resilient detent fingers are disposed in convergent relation and lie at an acute angle of less than 45° to said plane, and said detent fingers engage detent notches of said first positioning member on opposite sides of said plane.

3. The positioning device of claim 2, wherein, said second positioning member includes an integral panel portion at one side thereof disposed at right angles to said plane and extending toward said first positioning member, said detent fingers are integrally joined at one side thereof with said panel portion and at inner ends thereof with said body portion, and said locating element is joined at one end thereof with said panel portion and extends therefrom in a direction parallel to an axis of said mounting stud.

4. The positioning device of claim 2, wherein, the outer end portions of said detent fingers are convergently disposed at an angle of approximately 53°, and outer end extremities of said detent fingers have a V-shaped configuration for engagement with said detent notches.

5. The positioning device of claim 1, wherein, said connectors have a predetermined, uniform thickness dimension, in a transverse direction parallel to the hub axis, the body portion and detent finger of said second positioning member have a thickness dimension in the transverse direction substantially equal to that of said connectors, and said first positioning member has a thickness dimension in the transverse direction substantially equal to that of said connectors.

6. The positioning device of claim 1, wherein, the angularly spaced positioning teeth of said first positioning member form a series of generally V-shaped detent notches in said cylindrically contoured portion, and said detent finger has an end portion of generally V-shaped configuration positioned to engage with said detent notches.

7. A kit of parts for assembling an angularly adjustable joint for a construction toy, which comprises, at least two connectors, each of a type comprising a connector body formed of plastic material and including a cylindrical hub and at least two rod-gripping sockets, said hub having a hub axis and said rod-gripping sockets each having a socket axis intersecting with said hub axis at right angles thereto, each said socket having an inner end wall, spaced a uniform distance from said hub axis, and a pair of rod-gripping arms forming with said inner end wall a rod-gripping socket of generally U-shaped configuration adapted for a lateral snap-in connection with a rod element of said construction toy set, each of said rod-gripping arms having an internal rod-engaging rib on an inside thereof extending transversely to the socket axis and spaced a predetermined distance from the inner wall of said socket, at least one of said connectors having a transverse opening therein positioned radially outward from the hub thereof, at least one rod element, formed of plastic material, having flanged ends and annular grooves adjacent said flanged ends adapted for reception of said ribs, configured to be non-rotationally gripped by rod gripping sockets of each of a pair of laterally spaced apart connectors, with a longitudinal axis of said rod disposed in parallel relation to said hub axes and at right angles to said socket axes, said rod element having a generally X-shaped cross section in an intermediate region between said annular grooves defining longitudinal grooves engageable by said ribs when said rod element is transversely disposed between a pair of rod-gripping arms, a first positioning member formed with a first end portion of tubular form adapted to closely receive and be supported by portions of said rod element when said rod element extends between a laterally spaced apart pair of said connectors joined by said rod, said first positioning member being rotatable about a longitudinal axis of said rod element, said first end portion being configured to be received between and laterally closely confined by said pair of laterally spaced apart connectors engaged by said rod element, said first positioning member including a rod-gripping socket, corresponding to a rod-gripping socket of said connectors, spaced from and rigidly connected to said first end portion, said first end portion being cylindrically contoured over a substantial portion of its surface and said substantial surface portion being formed with a plurality of discrete and angularly closely spaced apart positioning detent notches, and a second positioning member configured to be positioned between and closely laterally confined by said laterally spaced apart pair of connectors and comprising a body portion and a mounting stud projecting from at least one side of said body portion on a stud axis and configured to be received within a connector hub of at least one of said laterally spaced apart connectors, said second positioning member having an anti-rotation element projecting from one side thereof in spaced apart relation to said stud axis and operable in combination with said mounting stud to engage with one of said connectors to prevent rotation of said second positioning member with respect to said one of said connectors, said second positioning member having at least one resilient detent finger extending from said body portion and configured to be engageable with the plurality of positioning detent notches of said first positioning member to accommodate controlled incremental rotational adjustment and retention of said first positioning element in a plurality of incrementally discrete predetermined angular orientations relative to said second positioning element.

8. A kit of parts according to claim 7, wherein said second positioning member comprises a panel portion extending along one side of said body portion at right angles to said stud axis, said at least one resilient element detent finger comprises a spaced apart pair of resilient detent fingers extending from said body member and along one side of said panel portion, and outer end portions of said resilient detent fingers are convergently disposed and positioned for engagement with spaced apart positioning detent notches on said first positioning member.

9. A kit of parts according to claim 8, wherein said resilient detent fingers are integrally molded along one side thereof with said panel portion, and said anti-rotation element is integrally molded with said panel portion and projects laterally therefrom and on the opposite side thereof from said positioning fingers.

10. A kit of parts according to claim 7, wherein said connectors are of a generally flat form and of a predetermined thickness, said first positioning element has a thickness equal to the predetermined thickness of said connectors, and said second positioning member, exclusive of said stud and said anti-rotation element, has a thickness equal to the predetermined thickness of said connectors.

11. A kit of parts according to claim 7, wherein the rod-gripping socket of said first positioning member comprises a bottom wall and spaced apart side walls disposed in a generally U-shaped configuration for lateral snap-in and snap-out assembly and disassembly of an additional rod element, the side walls of said rod-gripping socket are disposed in planes parallel to an axis of said first end portion, and said side walls define a socket axis intersecting with an axis of said tubular first end portion.

* * * * *